US008661606B2

(12) United States Patent
Kappos et al.

(10) Patent No.: US 8,661,606 B2
(45) Date of Patent: Mar. 4, 2014

(54) VACUUM NOZZLE TOOL INCLUDING FLUSH CLEAN COMPONENT

(76) Inventors: Paul Kappos, Centerville, UT (US); Mark D. Kappos, Ogden, UT (US); Dennis L. Pearlstein, Dripping Spring, TX (US)

( * ) Notice: Subject to any disclaimer, the term of this patent is extended or adjusted under 35 U.S.C. 154(b) by 916 days.

(21) Appl. No.: 12/693,309

(22) Filed: Jan. 25, 2010

(65) Prior Publication Data

US 2010/0223750 A1 Sep. 9, 2010

Related U.S. Application Data

(60) Provisional application No. 61/146,904, filed on Jan. 23, 2009.

(51) Int. Cl.
*A47L 7/00* (2006.01)

(52) U.S. Cl.
USPC ..... 15/322; 15/321; 15/345

(58) Field of Classification Search
USPC ..... 15/321, 322, 345
See application file for complete search history.

(56) References Cited

U.S. PATENT DOCUMENTS

| | | | | |
|---|---|---|---|---|
| 5,555,598 | A * | 9/1996 | Grave et al. | 15/322 |
| 5,706,548 | A * | 1/1998 | Schabacker | 15/322 |
| 6,513,192 | B1 * | 2/2003 | Pearlstein | 15/415.1 |
| 7,770,254 | B2 * | 8/2010 | Alexander | 15/321 |

* cited by examiner

*Primary Examiner* — Lee D Wilson
*Assistant Examiner* — Shantese McDonald
(74) *Attorney, Agent, or Firm* — Holland & Hart LLP; Bryan G. Pratt

(57) ABSTRACT

A vacuum nozzle for removing liquid from surfaces includes a nozzle body defining an internal enclosed vacuum chamber wherein the chamber is of a size and shallow depth so as to enhance water flow therethrough, the nozzle body also having a vacuum source connector in fluid communication with the chamber and adapted to receive a vacuum source conduit, and the nozzle body also having a hard outer bottom surface and defining a plurality of vacuum suction ports opening between the chamber and the bottom surface. The vacuum nozzle also includes at least one injection member, wherein the at least one injection member is configured to inject a fluid below the nozzle body, whereby the nozzle, when connected to a suction source is placed on a saturated surface effects removal of water therefrom through the ports and chamber to the vacuum source.

20 Claims, 8 Drawing Sheets

VACUUM NOZZLE TOOL INCLUDING FLUSH CLEAN COMPONENT

RELATED APPLICATION

This application claims the benefit under 35 U.S.C. §119 (e) of U.S. Provisional Patent Application No. 61/146,904 filed Jan. 23, 2009 titled "Vacuum Nozzle Tool Including Flush Clean Component." The provisional application is incorporated herein by reference in its entirety.

FIELD present invention relates to nozzles or suction heads for a surface cleaning apparatus. Specifically, the present exemplary system and method relates to a suction device including sub-surface cleaning features.

BACKGROUND

A wide variety of nozzles or suction heads for vacuum cleaners and vacuum apparatus are well-known in the art. U.S. Pat. No. 1,000,383 issued Aug. 15, 1911, to O. Drake for "Shoe for Vacuum Cleaners" shows a vacuum nozzle or shoe for a vacuum cleaner. This nozzle includes an interior vacuum chamber and a bottom plate with slots or openings therein. The slots include stock or wedding, apparently to prevent dirt from dropping back through the slots when the vacuum cleaner is not running. U.S. Pat. No. 5,398,361, issued Mar. 21, 1995, to K. Cason for "Vacuum Cleaner for Submerged Non-Parallel Surfaces" discloses a vacuum pool cleaner with a nozzle having an open bottom face. U.S. Pat. No. 2,280,751, issued Apr. 21, 1942, to H. Davis for "Vacuum Cleaner Nozzle" discloses a vacuum cleaner nozzle having a plurality of slots in a bottom plate opening through the plate into a relatively deep vacuum nozzle chamber leading directly to the vacuum hose. The nozzle is intended for dry vacuuming, being provided with an electrostatic bottom plate.

However, traditional nozzles fail to provide the ability to flush clean an area while removing fluids from under the carpet surface.

SUMMARY

The present exemplary system is embodied in an efficient vacuum nozzle for removing liquid from a surface which may be almost any surface. According to one exemplary embodiment, the present exemplary system is configured for use on carpeting and particularly well on padded carpeting.

According to one exemplary embodiment, a nozzle or suction head can be formed by a nozzle body defining an internal, enclosed vacuum chamber. A vacuum source connector is in fluid communication with the chamber and is adapted to receive a vacuum source conduit or hose.

The nozzle body also defines an outer bottom surface and a plurality of vacuum suction ports opening between the chamber and the nozzle body's bottom surface. As such, when the nozzle is connected to a vacuum source, its movement across a water or fluid saturated surface effects removal of water therefrom through the ports and chamber to the vacuum source.

Each port preferably has a throat portion opening into the chamber and a conical outer enlarged portion opening into the bottom surface.

According to one exemplary embodiment, the nozzle body including the vacuum suction ports includes a fluid injector cleat that is selectively retractable into the nozzle body.

According to this exemplary embodiment, the selectively retractable fluid injector cleat can be extended to inject fluid into a soiled area at or below the backing of the carpet to prevent the forcing of stain material into the backing and pad of the carpet while maintaining a constant upward flow of cleaning solution.

According to another exemplary embodiment, the nozzle body including the vacuum suction ports forms a perimeter suction chamber that, is sealed with the exception of a plurality of vacuum suction ports. The perimeter suction chamber defines a center port that is not in direct fluid communication with the suction chamber, but rather is configured to provide an area for flushing a cleaning fluid into a desired surface to facilitate cleaning thereof, whether by gravity feed or forced pressure. The flushing provided in the center port may be provided by any number of fluid delivery systems or nozzles. In one embodiment, the flushing may be provided in the center port by one or more fluid injector cleats that are selectively retractable such that they may provide cleaning fluid either above the carpet or below the backing.

DETAILED DESCRIPTION

Figure 1:
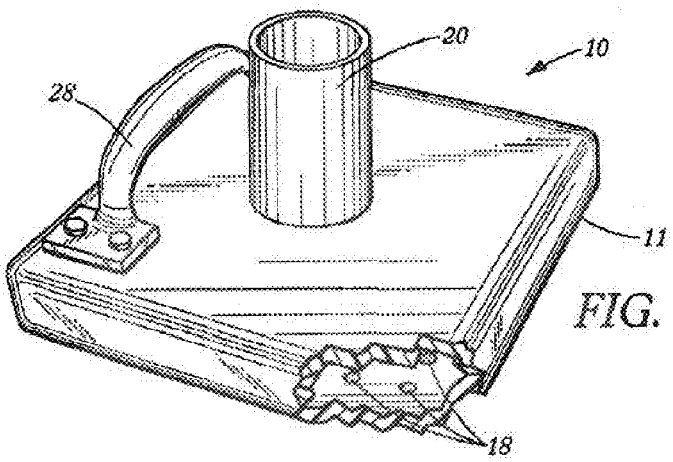
FIG. 1 is a front perspective view of a nozzle or suction head embodying the present invention with a portion cut away for clarity.

The present exemplary system provides an improved nozzle or suction head 10 finding particular but not necessarily exclusive utility for rapidly removing standing water from floors, particularly carpeted floors, following either accidental flooding or purposeful flooding, i.e. water saturation, for spotting and cleaning purposes. According to one exemplary embodiment, the nozzle 10 is formed as a hollow body 11 having an upper plate or wall 12, a bottom plate or wall 14, and side walls 15 defining a shallow, enclosed vacuum or suction chamber 16. The bottom plate 14 defines a plurality of suction ports 18 opening into the bottom surface 19 of the nozzle 10. As used herein, an enclosed vacuum or suction chamber 16 may be a single enclosed orifice or may be a plurality of interconnected runs or chambers fluidly connected.

According to one exemplary embodiment, suction is applied to the suction chamber 16 via a vacuum source connector such as a suction sleeve or tube 20 that opens through a port 21 in the top plate 12 and receives an inserted end of a suction wand, tube, hose or conduit 22 connected to a vacuum or suction producing and water collecting apparatus (not shown). As such, the vacuum source connector is in fluid communication with the chamber, thereby enabling a vacuum to be established in the chamber when a vacuum hose is attached to the connector and the vacuum source, i.e. suction producing apparatus, is activated. While the vacuum source connector is described herein as being formed on the top plate 12, it is understood that the vacuum source connector may be placed in any number of locations on the exemplary system.

The suction ports 18 are defined, according to one exemplary embodiment, by a throat portion 24 opening into the water chamber 16, and a tapered or cylindrical counterbore 25 opening into the outer surface 19 of the base plate 14.

Figure 4:
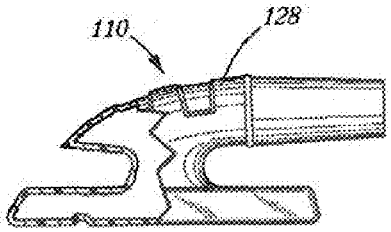
FIG. 4 is a side elevation view of another nozzle or suction head of the present invention with a portion also cut away for clarity.

To facilitate moving the nozzle or suction head 10 across a surface such as carpet 26 against the friction forces between the carpet surface 26 and the suction head surface 19, a handle 28 or set of handle supporting brackets (not shown) is provided on the nozzle 10. Alternatively, the handle may be incorporated as a part of the vacuum connector as shown in FIG. 4.

According to one exemplary use, the nozzle 10 is connected to a vacuum tube, wand, hose or conduit 22 by inserting an end thereof into the upwardly extending fitting tube 20 on the nozzle body 11. The vacuum and water or solution collecting device (not shown but known to those skilled in the art) is turned on to provide a vacuum or suction, causing air to flow through the nozzle ports 18 in to the chamber 16. When the nozzle is applied to a water-soaked surface such as a carpet, water is sucked through the ports 18 into the chamber 16 and then through the outlet port 21 and tube 20 into the vacuum hose or tube through which it flows to the collection device. In this manner, water is rapidly and efficiently removed from the carpet and its padding 29 (or other surface) by moving the nozzle 11 along the surface, using the handle 28 to apply the necessary sliding force.

The nozzle may be constructed of any number of materials including, but in no way limited to, plastic, such as a high impact moldable plastic, polycarbonate for example, or a lightweight metal such as aluminum. Additionally, according to one exemplary embodiment, the nozzle may be formed by a pair of spaced plates forming the upper and lower plates 12, 14, joined by a hollow frame defining the side walls 15 and establishing the depth of the chamber 16. The chamber 16 is of a size and depth such that it provides adequate suction and water flow, and of a depth sufficiently shallow to preclude collection of water therein.

The plates and side wall frame may be coupled together via any number of joining methods or processes including, but in no way limited to, welding, adhesive, fasteners, or by forming the system from a single mold. Additionally, according to one exemplary embodiment, the plates and side wall frame may be coupled with any number of seals such as a gasket or o-ring.

The nozzle 10 thus formed may be square, rectangular, elongated, circular, elliptical or the like. The ports 18 may be arranged thereon in any suitable pattern, including columns and rows, a random arrangement, a spiral, concentric circles, or other appropriate geometric design. The outlet portion 25 of the ports 18 may be conical, semi-spherical, cylindrical or any other appropriate shape or configuration. According to one exemplary embodiment, the bottom surface 19 of the nozzle into which the suction ports 18 open is relatively smooth and free of projections in order to permit the suction device 10 to be readily moved across the surface of the carpet or floor without biting into the carpet or floor 18. According to another exemplary embodiment, the outlet portion 25 of the ports 18 are expanded and organized such that they overlap, forming an undulating or irregular bottom surface.

The suction hose receiving sleeve or tube 20 on the upper plate 12 of the nozzle or suction head 11 may be at any position thereon, and may be either perpendicular or at an angle to the surface of the upper plate 12. The handle 28 may be short or long, or a bracket may be provided for attaching a long or short handle to the nozzle.

Figure 2:
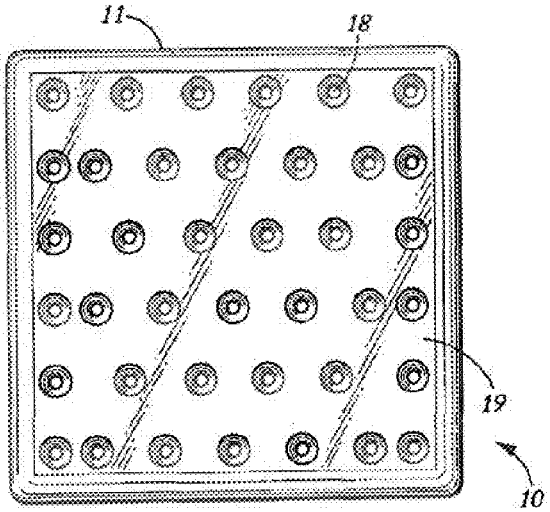
FIG. 2 is a bottom plan view of the nozzle or suction head embodying the present invention head shown in FIG. 1.
Figure 3:
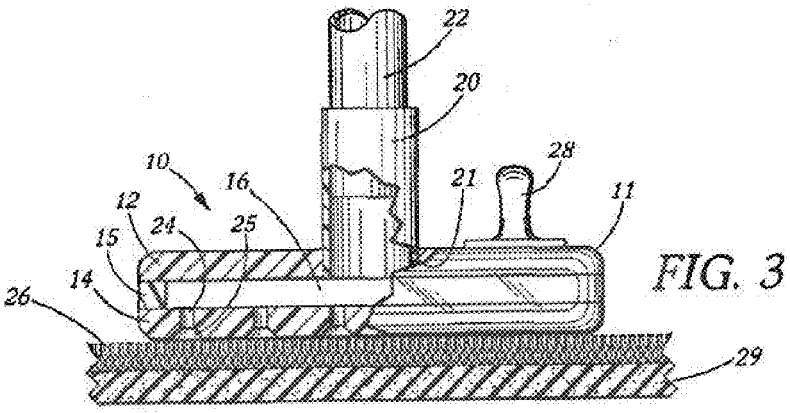
FIG. 3 is a side elevation view of the nozzle or suction head shown in FIG. 1 with a portion cut away for clarity.

In one exemplary embodiment as shown in FIGS. 1-3, the nozzle or suction head is formed of high impact plastic such as thermoplastic resin, with square upper and lower walls of 8 inches by 8 inches and a thickness of ½ inch. The side wall forming spacer, according to the exemplary embodiment, has a thickness of ½ inch and provides a chamber of a depth of approximately ½ inch. The edges or corners of the nozzle materials are rounded in order to present catching and dragging on carpet. When the nozzle is formed of plastic material, a liquid glue or solvent can be utilized to securely fasten the pieces together in vacuum-tight and watertight relation. Vacuum water collecting sources suitable for attachment to the nozzle include any wet/dry shop vac, any portable carpet cleaning machine and any truck mounted carpet cleaning machine as such are known to those skilled in the art.

According to one exemplary embodiment, the nozzle or suction head may be utilized to remove spots or stains on carpeting by purposefully flooding the stained area with water and stain remover, allowing the water/stain remover solution to set for a period of time (30 seconds to 72 hours) which is sufficient to saturate the stained area of the carpet, and then vacuuming the liquid from the carpeting and its padding (or other surface particularly fabrics as discussed above) with a nozzle preferably embodying the present configuration.

The stain remover may be of a type for removing the particular stain being treated. For example, if pet or urine stain is to be removed suitable stain removers include Nature's Miracle available from Pets and People, Inc. of Rolling Hills Estates, Calif. and Aqua Pet Zyme available from Innovative Products of Englewood, Colo. These products can be mixed with water or another solution in accordance with the product's instructions which when mixed provide the above water/stain remover solution.

It has been observed that a nozzle constructed as described above is capable of removing approximately 98 percent of the solution utilized from the carpeting and doing it very quickly.

In accordance with an exemplary embodiment of the present system and method, at least 50% of the solution is vacuumed out of the carpeting, preferably between about 70 and 98%. In addition and as alluded to above, the method of the present exemplary system and method is capable of quickly removing solution from the carpeting (including the padding). Indeed, it has been found that (depending on the thickness and density of the carpeting and padding) 70% or more of the water or solution can be removed (or vacuumed) from the carpeting (including the padding) at rates of less than two minutes per square foot. Less than one minute per square foot is also easily achievable. In fact, if the vacuum source is strong enough (for example, similar to that provided by a truck mounted system known to those skilled in the art) rates of less than 30 seconds per square foot have been found to remove up to 98% of the liquid from the carpeting and its padding.

Vibration devices such as a rotary head device known to those skilled in the art may be applied to the nozzle to enhance water extraction. Further enhancement of water extraction can be obtained by making the device large and strong enough to allow a user to stand on it. This increases pressure on the carpet which enhances liquid removal.

FIG. 4 illustrate another nozzle 110 of the present exemplary system and method which is similar to nozzle 10 of FIGS. 1 through 3 except that handle 28 and suction connector sleeve 20 have been replaced by a single suction handle 128. As will be appreciated, suction handle 128 serves as, i.e. provides the functions of, both handle 28 and connector sleeve 20.

Figure 5A:
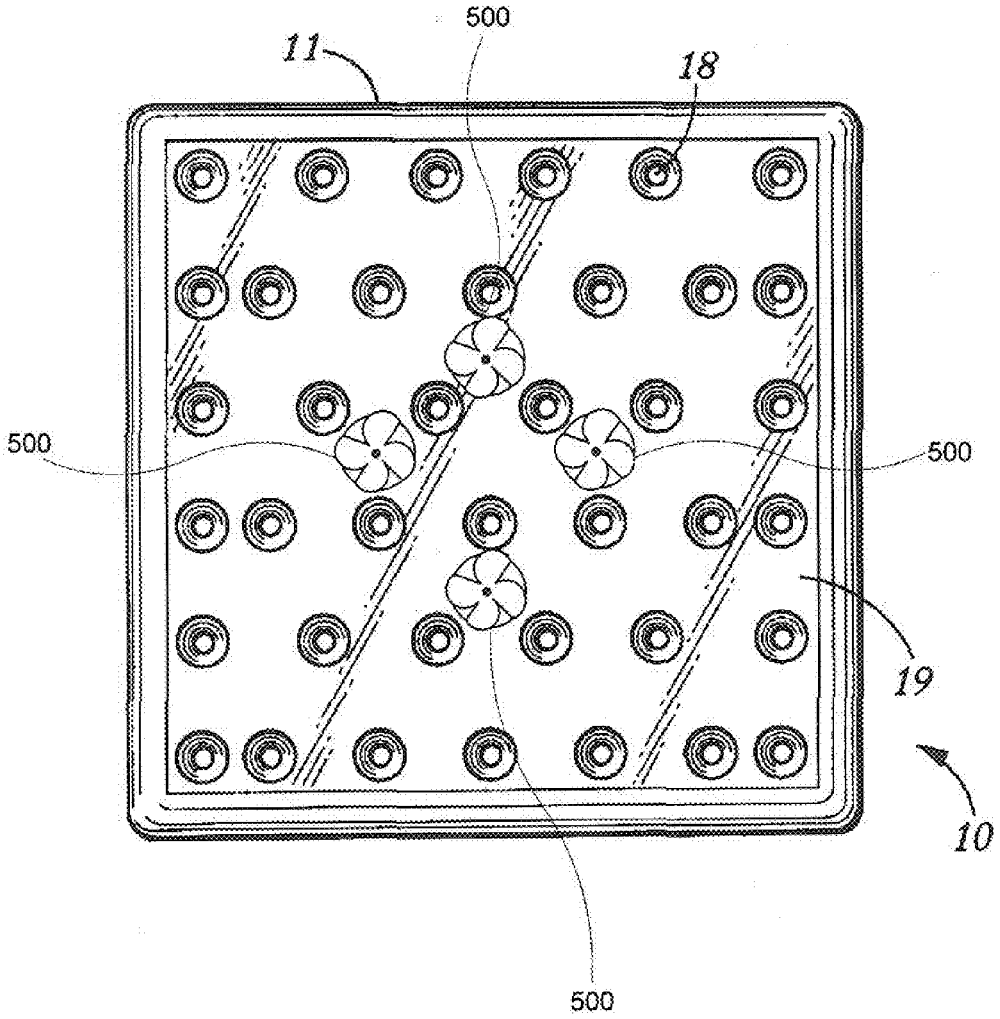
FIG. 5A is a bottom plan view of the nozzle or suction head including a number of injector cleats, according to one exemplary embodiment.

FIG. 5A illustrates another exemplary embodiment of the present suction head. As illustrated in FIG. 5A, the nozzle body 11 including the vacuum suction ports 18 forms a suction chamber that is sealed with the exception of a vacuum port on the chamber and the nozzles 18. The bottom of the outer surface 19 of the suction chamber is illustrated with a plurality of injection cleats 500 disposed thereon. According to this exemplary embodiment, the injections cleats 500 are fluidly sealed within the suction head 11 such that their presence does not impact or reduce the vacuum created within the nozzle 10 by the suction sleeve or tube 20. According to the present exemplary embodiment illustrated in FIG. 5A, the injector cleats 500 are configured to provide a method for introducing a cleaning and/or flushing fluid onto a soiled area without forcing dirt or a stain into the backing and/or padding of the carpet where its removal becomes more difficult. Additionally, as described below, the present exemplary injector cleats 500 are configured to enhance the stain lifting ability of the suction head 11 while optimizing flow of the injected cleaning and/or flushing fluid.

Figure 5B:
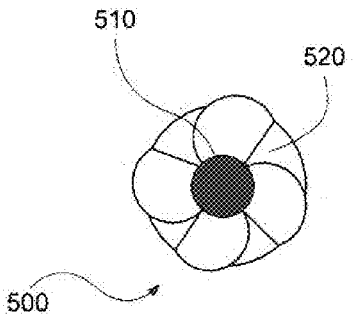
FIGS. 5B-5C is a bottom view and a side view, respectively of an injector cleat, according to one exemplary embodiment.
Figure 5C:
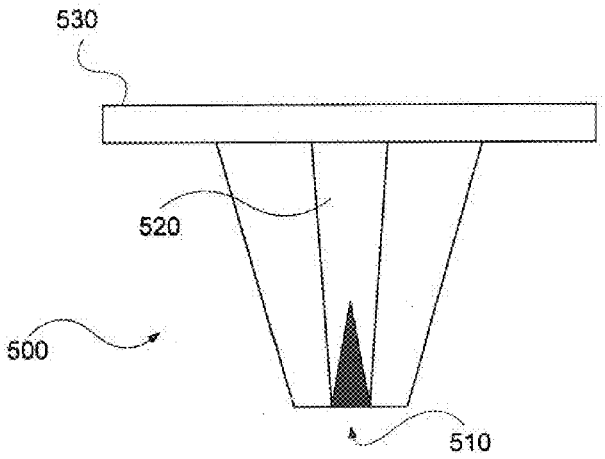

FIG. 5B illustrates a bottom view of the injector cleat 500, according to one exemplary configuration. As illustrated, the injector cleat 500 includes a center spray orifice 510 and a plurality of chamfers in the sidewall of the injector cleat 500 forming channels 520. As illustrated in FIGS. 5B and 5C, the inclusion of the channels 520 in the sidewall of the injector cleat 500 creates a side nozzle component of the spray orifice 510. FIG. 5C also illustrates the cleat cap 530 of the injector cleat 500.

Figure 6:
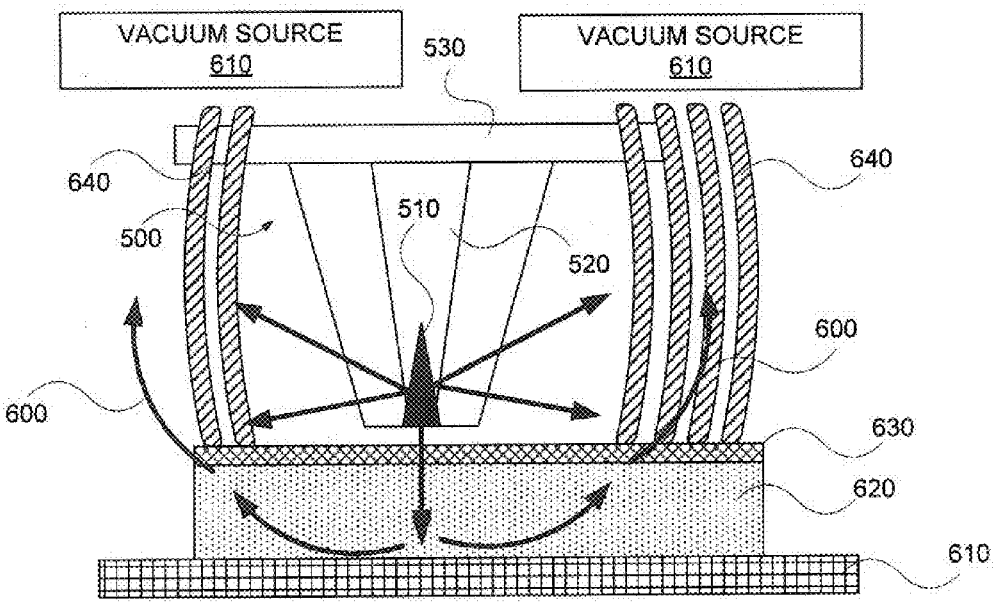
FIG. 6 is a side cross-sectional view of the present nozzle or suction head in operation, according to one exemplary embodiment.

Additionally, as illustrated in FIG. 5C and FIG. 6, the injector cleat 500 includes an angled sidewall approaching a point at the spray orifice 510. According to one exemplary embodiment, the point created at the spray orifice 510 is sized to pierce and pass through the carpet backing 630 such that any cleaning and/or flushing fluid introduced will be introduced directly into the pad 620 and sub-floor 610. Alternatively, the converging walls of the injector cleat 500 terminate at the spray nozzle 510. The converging walls cause the injector cleat 500, when pushed into the carpet fiber 640 to pass through the carpet fiber placing the spray orifice 510 directly against the carpet backing 630.

According to one exemplary embodiment, illustrated in FIG. 6, the present exemplary injector cleat 500 is configured to inject cleaning and/or flushing fluid beyond the backing of a soiled carpet without driving the components of the stain into the backing and pad where they become more difficult to remove. Additionally, as illustrated in FIG. 6, the present exemplary injector cleat 500 also has a side spray component in order to provide cleaning and/or flushing fluid to the carpet fibers 640 themselves without driving contaminants in a downward direction. According to one exemplary embodiment, the at least partial saturation of the carpet fibers 640 with cleaning and/or flushing fluid performs a number of functions. First, partial saturation of the carpet fibers 640 is advantageous in that it extends the vacuum created by the suction sleeve or tube 20 downward by preventing air to flow through the fibers to circumvent the lift provided by the vacuum. Rather, the vacuum is extended downward to lift contaminants from the backing and padding of the carpeted surface.

Additionally, according to one exemplary embodiment, the partial saturation of the carpet fibers 640 by the injector cleat 500 is performed in a lateral direction rather than a downward direction. Consequently, any contaminants or stain components that are saturated by the cleaning and/or flushing fluid of the present exemplary system are driven laterally rather than driven downward into the carpet backing and padding, as is done by traditional systems, where they can be more easily removed by the suction head 11.

According to one exemplary embodiment, illustrated in FIG. 6, the present exemplary system and method allow for the introduction of the cleaning and/or flushing fluid for the removal of stain components without flooding the carpeted surface of the soiled location. Specifically, when a soiled area is flooded with cleaning and/or flushing fluid in preparation for removal of the stain components, the flooding process does two things. First, the application of the flooding/flushing fluid to the surface of the carpet drives the components of the stain further into the backing, padding and sub-floor, where the stain components become more difficult to remove. Secondly, the traditional flooding method of flooding a soiled area with cleaning and/or flushing fluid in preparation for removal of the stain components causes a radial migration of the stain components. That is, upon flooding of an area with flooding/flushing fluid, the fluid is going to be absorbed in a radial direction from the location of introduction on the carpeted surface. With the radial dispersion of the flooding/flushing fluid, the stain components are also dispersed radially. Consequently, the traditional method of flooding a soiled area often results in the soiled area becoming larger prior to attempts to remove the stain.

In contrast to traditional flooding methods, as illustrated in FIG. 6, the use of the injector cleat 500 prevents a driving of the stain contaminants further into the carpet backing 630, the pad 620, and the sub-floor 610 by creating a generally upward fluid flow 600 of the introduced cleaning and/or flushing fluid. That is, as illustrated in FIG. 6, cleaning and/or flushing fluid is introduced to the soiled area by the injector cleat at a location adjacent to or below the carpet backing 630. Due to this positional introduction of the cleaning and/or flushing fluid, horizontal spray of cleaning and/or flushing fluid from the injector cleat 500 will tangentially engage the carpet fiber 640 and any stain components without driving them further into the carpet backing 630 or pad 620. Once saturated in the carpet fiber 640, the vacuum source 610 can then impart an upward force on the stain components, thereby removing them from the carpet fibers. Similarly, the spray orifice 510 emits a downward component of the cleaning and/or flushing fluid. As the injector cleat 500 is directly adjacent to or below the carpet backing 630, no stain components are transferred down from the carpet fiber 640 to the backing 630. Rather, the downward component of the cleaning and/or flushing fluid sprayed through the spray orifice 510 of the injector cleat 500 is injected directly into the carpet backing 630, pad 620, and sub-floor 610 of the desired area. Once injected, the cleaning and/or flushing fluid is then acted upon by the vacuum source 610 and drawn up to the suction head 11. As illustrated in FIG. 6, this configuration results in an overall upward flow of cleaning and/or flushing fluid toward the vacuum source 610, thereby maximizing the flow of the cleaning and/or flushing fluid up and away from the sub-floor 610.

Figure 7:
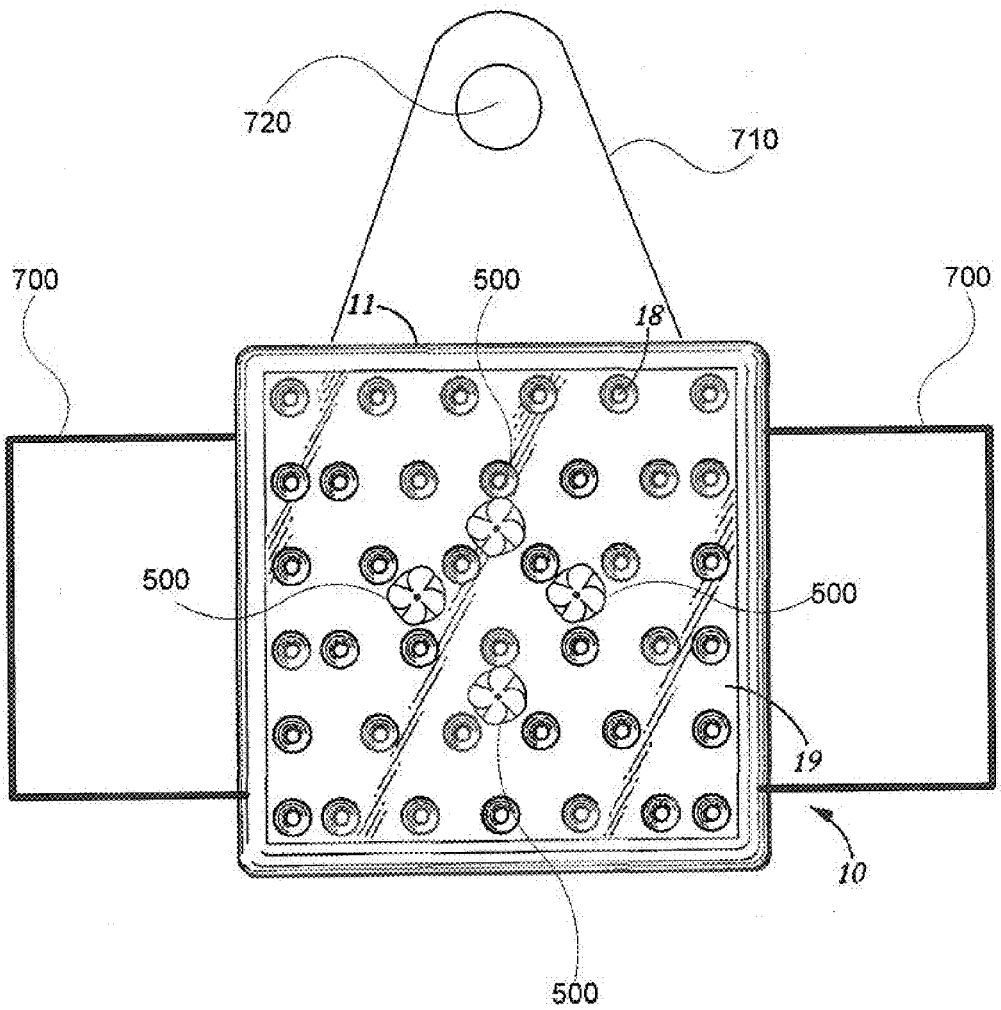
FIG. 7 is a bottom view of the present nozzle or suction head, according to one exemplary embodiment.

FIG. 7 illustrates additional components of the present exemplary nozzle 10 configuration, according to one exemplary embodiment. As illustrated in FIG. 7, the exemplary configuration includes the injector cleats 500 formed in the bottom surface of the suction head 11 along with the ports 18. Additionally, according to the exemplary embodiment illustrated in FIG. 7, a plurality of foot pads 700 are formed on the sides of the suction head 11. According to the illustrated embodiment, the foot pads 700 may be foldable about the housing of the suction head 11 such that they may be retracted when not in use. When extended, a user may use the foot pad 700 to introduce a downward force on the nozzle 10 when in use. The addition of a downward force provides sufficient force to introduce the injector cleats 500 through the carpet fibers 640 and to the carpet backing 630. Additionally, according to one exemplary embodiment described below with respect to FIG. 10, the foot pads 700 may be used to actuate the selective extension of the injector cleats 500.

Continuing with FIG. 7, a pump base 710 is formed on the top surface of the suction head 11. According to this exemplary embodiment, the pump base 710 is formed to include a plunger or pump source 720 formed thereon. According to this exemplary embodiment, the plunger or pump source 720 is fluidly connected to the injector cleats 500 to provide cleaning and/or flushing fluid to the injector cleat 500. As illustrated in FIG. 7, the pump base 710 forms a three contact point configuration with the foot pads 700. This three point configuration adds stability to the nozzle 10 configuration by preventing a user from falling or otherwise tipping when operating the nozzle.

Figure 8:
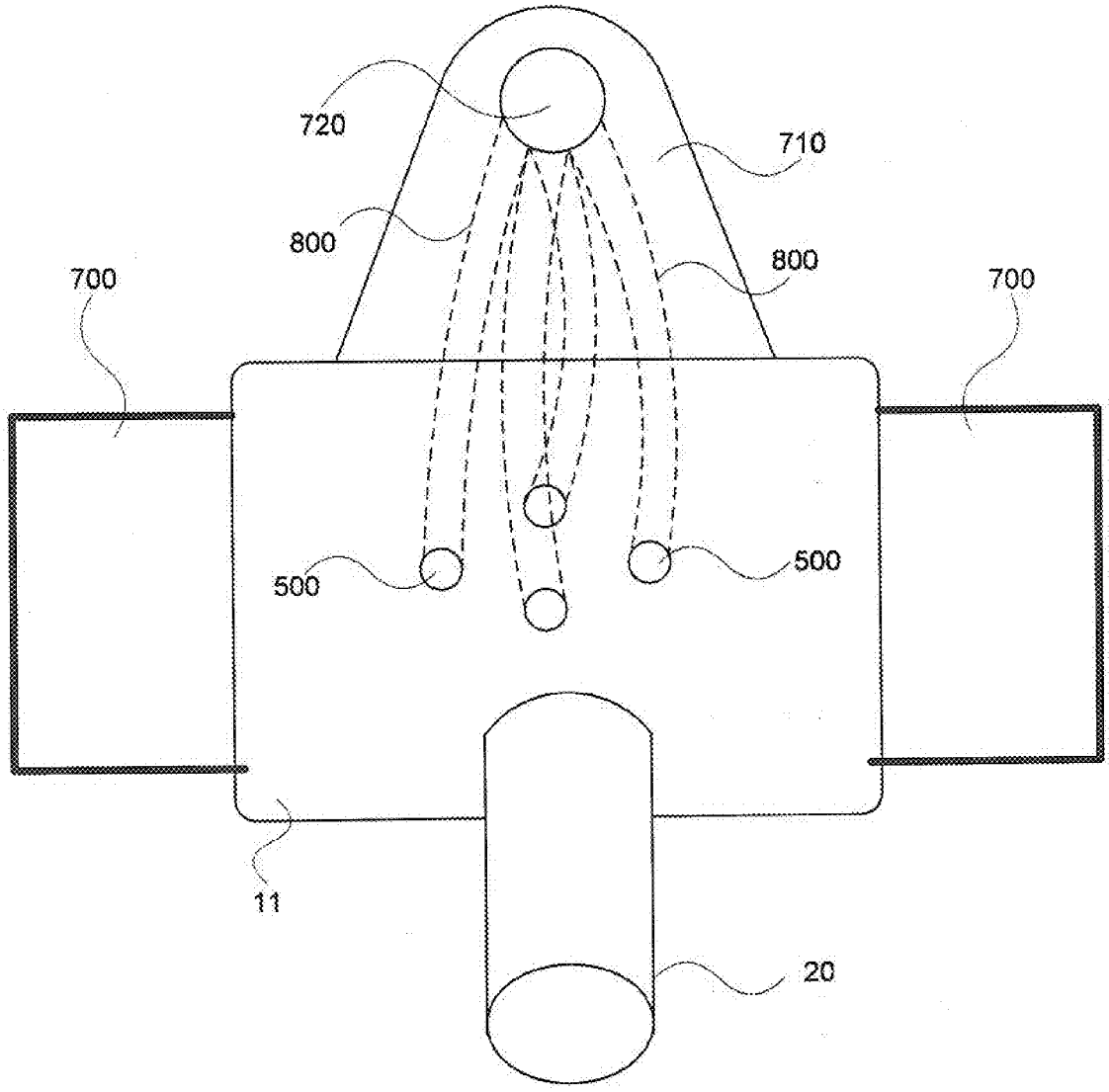
FIG. 8 is a top view of the present nozzle or suction head, according to one exemplary embodiment.

Turning now to FIG. 8, a top view of the exemplary nozzle 10 configuration shows a number of fluid lumens 800 coupling the plunger or pump source 720 to the injector cleats 500. As illustrated, during operation, when a user desires to actuate the injector cleats 500, the cleats are extended and inserted into the desired location of the carpeted surface. Once inserted, the user may stand on the foot pad 700 providing a downward force on the system, thereby forcing the cleats 500 into or directly adjacent to the carpet backing 630. A user may then actuate the plunger or pump source 720, either by, for example, actuating an electric pump or by forcing a plunger down, to force cleaning and/or flushing fluid through the fluid lumens 800 and into the injector cleats 500.

Figure 9:
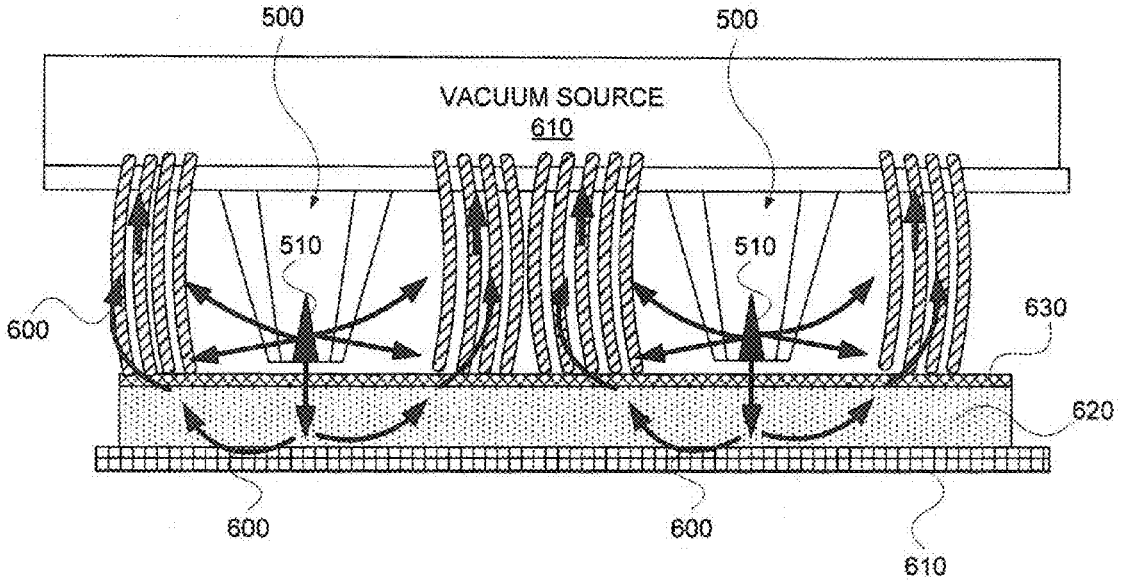
FIG. 9 is a side cross-sectional view of the present nozzle or suction head in operation, according to one exemplary embodiment.

Similar to FIG. 6, FIG. 9 illustrates the operation of the present exemplary nozzle 10, according to one exemplary embodiment. As shown, the injector cleat 500 is positioned at least adjacent to the carpet backing 630. When actuated, the cleaning and/or flushing fluid is forced horizontally into the carpet fibers 640 and downward into the carpet backing 630, pad 620, and sub-floor 610. The cleaning and/or flushing fluid is then acted upon by the vacuum source 610 through the ports 18 such that the fluid flow 600 is substantially upward from the sub floor 610 to the top of the carpet fiber 640. This configuration enables maximum efficiency in removing stain particles, odors, and fluids by imparting an upward force by the vacuum source 610 at the most effective positions since particles, odors, and fluids are not forced downward prior to extraction.

Figure 10:
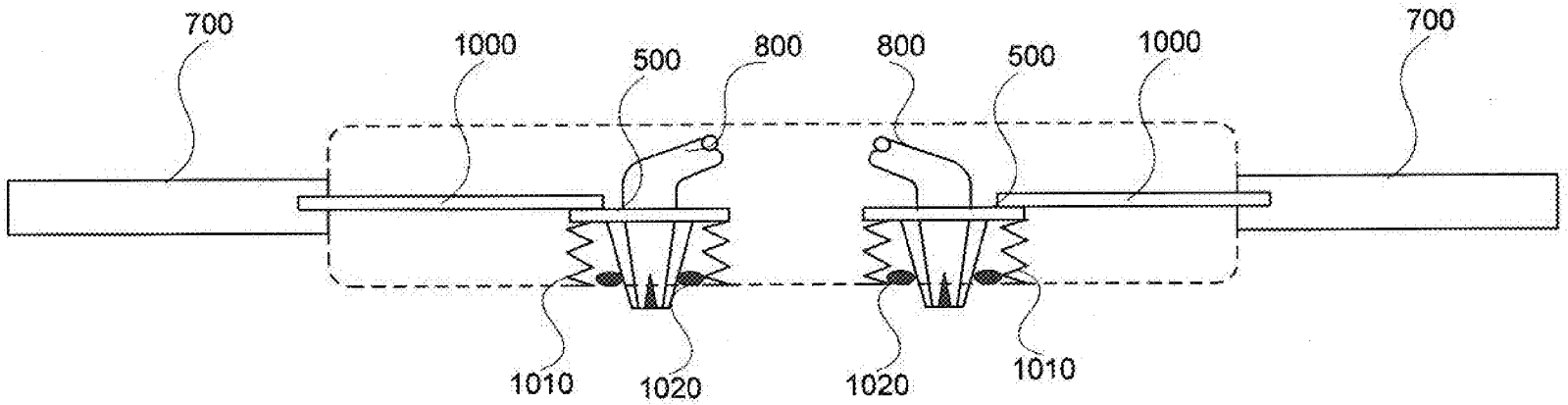
FIG. 10 is a side cross-sectional view of the present nozzle or suction head, according to one exemplary embodiment.

FIG. 10 is a side cross-sectional view of the present exemplary nozzle 10, according to one exemplary embodiment. As shown, the injector cleats 500 coupled to the fluid lumens 800 are disposed within the suction head 11. According to one exemplary embodiment, the injector cleats are maintained in their retracted position by a plurality of biasing spring members 1010 that impart an upward force on the injector cleat 500 when not in use. According to this exemplary embodiment the injector cleat does not interfere with normal use of the suction nozzle 10 when injection is not desired. Additionally, FIG. 10 illustrates a plurality of o-rings or other fluid tight sealing members 1020 surrounding the injector cleats 500 at the surface of the suction head 11. According to one exemplary embodiment, the plurality of o-rings or other fluid tight sealing members 1020 are configured to form an airtight seal around the injector cleats 500 when not in use. Consequently, the integrity of the suction head 11 is maintained, allowing for maximum efficiency of the vacuum ports 18. FIG. 10 also illustrates an injector coupling structure 1000 structurally coupling the foot pad 700 with the injector cleats 500. According to this exemplary embodiment, when a user steps on the foot pad 700, the downward force imparted by the user onto the foot pads 700 is transferred via the injector coupling structure 1000 to the injector cleats 500 such that the injector cleats overcome the spring force of the biasing spring members 1010 and extend from the suction head 11 to at least the backing of the carpeted surface. According to this exemplary embodiment, the plurality of o-rings or other fluid tight sealing members 1020 maintain a fluid tight seal about the perimeter of the injector cleats 500 in all positions.

According to the present disclosure, the exemplary suction nozzle 10 configurations have been described by way of example only. It will be understood that many modifications may be made to the teachings of the present exemplary system and method. For example, according to one exemplary embodiment, the extension and retraction of the injector cleats 500 may be performed by actuation of any number of mechanisms including, but in no way limited to, a roller, a dial, and the like. Alternatively, the incorporation and functionality of the injector cleats 500 may be incorporated into the suction nozzle as shown above, or may be added as a retrofit attachment. Alternatively, the injector cleat system may be a stand-alone configuration independent of the suction nozzle.

Figure 11:
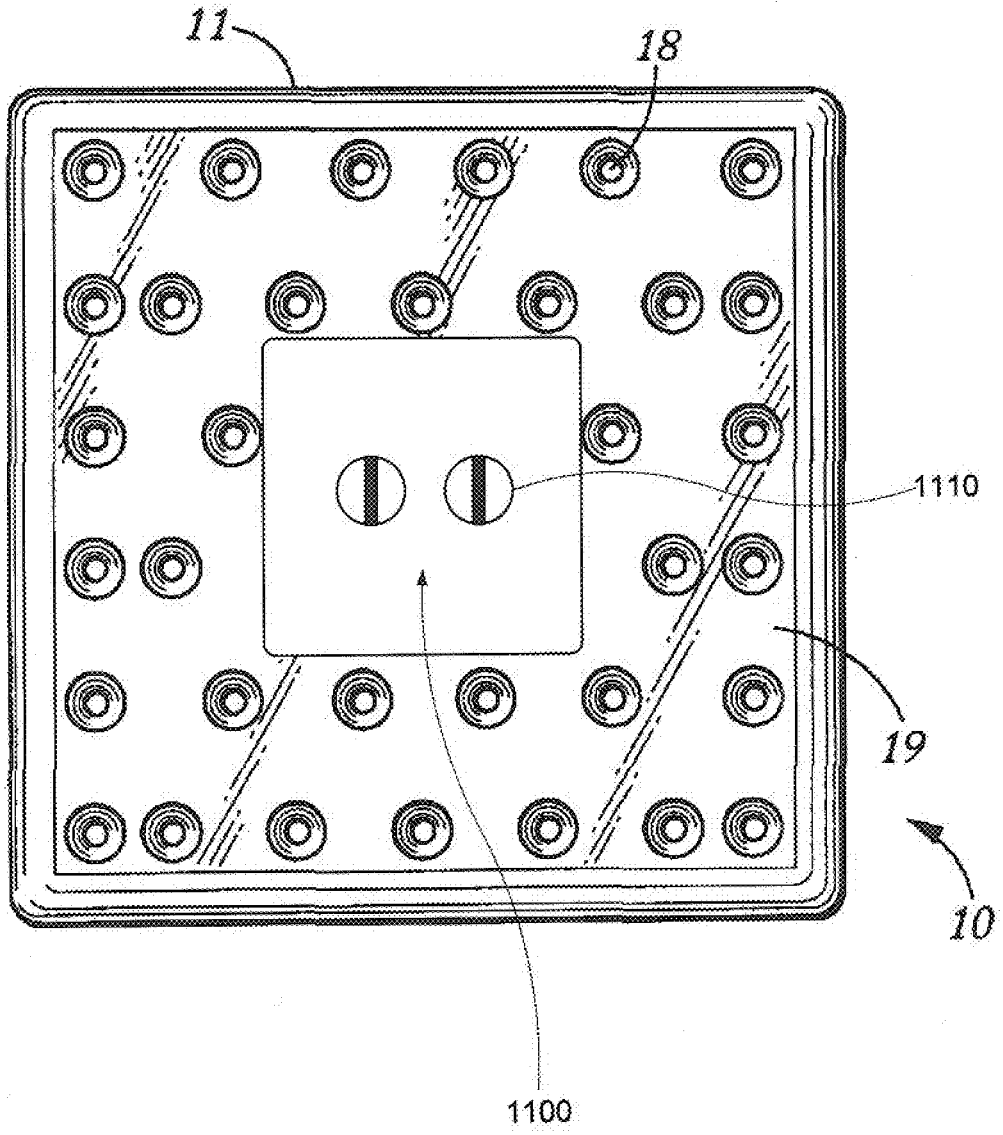
FIG. 11 is a bottom plan view of a nozzle or suction head including a flush clean orifice defined by the suction chamber, according to one exemplary embodiment.

FIG. 11 illustrates another exemplary configuration of the present exemplary suction head. As illustrated in FIG. 11, the nozzle body 11 including the vacuum suction ports 18 forms a perimeter suction chamber that is sealed with the exception of a vacuum port on the chamber and the nozzles 18. The outer surface 19 of the suction chamber defines a center port 1100 that is not in direct fluid communication with the suction chamber, but rather is configured to provide an area for flushing, whether by gravity feed, forced pressure, or injection cleats, a cleaning fluid into a desired surface to facilitate cleaning thereof. As illustrated in FIG. 11, a number of nozzles 1110 may be placed in the center port to selectively force fluid, such as water or a cleaning solution, onto a surface to be cleaned. While the present exemplary embodiment is illustrated with pressure forced nozzles being placed, in the center port 1100, any number of fluid flushing devices or configurations may be used including, but in no way limited to, a gravity fed delivery system, a pressurized delivery system, a sub-surface injection cleat, and the like. Additionally, while the center port 1100 is illustrated as an open orifice containing nozzles 1110, the center port may also be an area on the outer surface 19 without nozzles 18 or other means for imparting a suction force in the central area of the system.

According to the exemplary embodiment illustrated in FIG. 11, chemical and/or water are allowed to flow into the center port 1100, as directed by the operator. Selective distribution of the liquid may be performed by a regulator, a trigger device, a mechanical metering device, and the like. Alternatively, water may be allowed to freely flow through the center port 1100.

As illustrated, any fluid that is distributed through the center port is surrounded on the perimeter by the perimeter suction chamber including the nozzles. Consequently, the present exemplary configuration allows for a flush flood clean while under a vacuum condition. Consequently, a stain or pet odor that exists on a surface to be cleaned is flushed fully from the problem area without allowing the cleaning fluid or water to seep into other areas of the carpet, matting, or other surface. Not only does this exemplary configuration improve the level of cleaning that is achieved by the suction head, but also decreases the clean time because the head is more efficient at removing an undesired stain or odor with fewer passes of the tool. Additionally, contrary to traditional systems, the present exemplary configuration allows for pet odor removal and stain removal to be performed with a single device. Furthermore, the present configuration prevents the stain material and/or pet odor from being driven into the carpet pad, only to re-surface later. Rather, regardless of the direction the operator moves the suction head, any fluid flushed into the surface will be passed over by and removed by a nozzle in a vacuum state.

While certain illustrative embodiments of the present exemplary system and method have been shown in the drawings and described above in detail, it should be understood that there is no intention to limit the exemplary system and method to the specific form disclosed. On the contrary, the system and method is to cover all modifications, alternative constructions, equivalents and uses falling within the spirit and scope of the system and method as expressed in the appended claims. Such modifications could include, for example, slit shaped, slot-like or oval shaped ports or any other shape providing good water extraction.

What we claim is:

1. A vacuum nozzle for removing liquid from carpeted surfaces, comprising:

a nozzle body defining an internal enclosed vacuum chamber wherein said chamber is of a size and shallow depth so as to enhance water flow therethrough, said nozzle body also having a vacuum source connector in fluid communication with said chamber and adapted to receive a vacuum source conduit, and said nozzle body also having a outer bottom surface and defining a plurality of vacuum suction ports opening between said chamber and said bottom surface; and at least one injection member, wherein said at least one injection member is configured to extend beyond said outer bottom surface and inject a fluid below said nozzle body;

whereby said nozzle, when connected to a suction source is placed on a saturated surface effects removal of water therefrom through said ports and chamber to said vacuum source.

2. A vacuum nozzle as claimed in claim 1 wherein said vacuum source connector defines a outer surface which is sized and configured to serve as a handle for said nozzle.

3. A vacuum nozzle according to claim 1, wherein said at least one injection member is configured to inject said fluid into a carpeted surface below a surface of said carpeted surface.

4. A vacuum nozzle according to claim 3, wherein:

said carpeted surface includes fibers, a carpet backing, a pad, and a sub-floor;

wherein said at lest one injection member is configured to inject said fluid into said carpeted surface at said carpet backing.

5. A vacuum nozzle according to claim 3, wherein:

said carpeted surface includes fibers, a carpet backing, a pad, and a sub-floor;

wherein said at lest one injection member is configured to inject said fluid into said carpeted surface below said carpet backing.

6. A vacuum nozzle according to claim 1, wherein said at least one injection member further comprises:

a body having a proximal end and a distal end, wherein said body is defined by converging sidewalls converging from said distal end to said proximal end; and an injection orifice defined in said proximal end.

7. A vacuum nozzle according to claim 6, further comprising at least one chamfered channel formed on one of said converging sidewalls.

8. A vacuum nozzle according to claim 7, wherein said chamfered channel defines a side spray component of said injection orifice.

9. A vacuum nozzle according to claim 6, wherein said injection member is selectively retractable within said chamber.

10. A vacuum nozzle according to claim 9, further comprising:

an injection orifice defined by said nozzle body, said orifice sized for the selective extension and retraction of said at least one injection member;

a sealing member sealingly disposed adjacent to said injection orifice to fluidly seal said injection member at said injection orifice.

11. A vacuum nozzle according to claim 10, further comprising at least one biasing member disposed between said injection member and an outer surface of said nozzle body;

wherein said biasing member maintains a retracted state of said injection member until actuated.

12. A vacuum nozzle according to claim 11, further comprising:

at least one foot pad coupled to a side of said nozzle body.

13. A vacuum nozzle according to claim 12, wherein said at least one foot pad is retractable.

14. A vacuum nozzle according to claim 12, wherein said at least one foot pad is coupled to said at least one injection member;

wherein a force imparted on said at least one foot pad is transferred to said at least one injection member to overcome said biasing member and extend said injection member.

15. A vacuum nozzle according to claim 14, further comprising:

a first and a second foot pad; and a fluid pump source mount coupled to said nozzle body, said fluid pump source mount having a fluid pump source disposed thereon;

wherein said fluid pump source forms a triangle with said first and second foot pad.

16. A vacuum nozzle according to claim 15, further comprising at least one fluid lumen coupling said fluid pump source to said injection member.

17. A vacuum nozzle for removing liquid from surfaces, comprising:

a nozzle body defining an internal enclosed vacuum chamber wherein said chamber is of a size and shallow depth so as to enhance water flow therethrough, said nozzle body also defining an upper vacuum source port opening into said chamber;

a vacuum source connector affixed to said nozzle body and opening into said port and adapted to receive a vacuum source hose;

said nozzle body having a bottom plate defining an outer bottom surface;

said bottom plate defining a plurality of vacuum suction ports opening between said chamber and said bottom surface, each said port having a throat portion opening into said chamber and an outer enlarged portion opening into said surface;

at least one injection member disposed in said bottom plate, wherein said at least one injection member is selectively extendable from said bottom plate and is further configured to inject a fluid below said nozzle body; and a center port defined by said nozzle body, said center port being surrounded by said vacuum chamber and wherein said center port is not in direct fluid communication with said vacuum chamber;

wherein said center port is in selective fluid communication with a flushing fluid;

whereby moving said nozzle when connected to a suction source across a water saturated surface effects removal of water therefrom through said ports and chamber to said vacuum source while enabling selective flushing of said surface.

18. A vacuum nozzle as defined in claim 17 wherein said outer portion of said suction ports is conical in configuration.

19. A vacuum nozzle according to claim 17, wherein said at least one injection member is configured to inject said fluid into a carpeted surface below a surface of said carpeted surface.

20. A vacuum nozzle for removing liquid from surfaces, comprising:

a nozzle body defining an internal enclosed vacuum chamber wherein said chamber is of a size and shallow depth so as to enhance water flow therethrough, said nozzle body also having a vacuum source connector in fluid communication with said chamber and adapted to receive a vacuum source conduit, and said nozzle body also having a outer bottom surface and defining a plurality of vacuum suction ports opening between said chamber and said bottom surface;

wherein said nozzle body defines a fluid port that is not in fluid communication with said internal enclosed vacuum; and at least one injection member, wherein said at least one injection member is configured to extend beyond said outer bottom surface and inject a fluid through said fluid port;

whereby said vacuum nozzle, when connected to a suction source is placed on a saturated surface effects removal of water therefrom through said ports and chamber to said vacuum source.

* * * * *